US005211703A

United States Patent [19]

Ferleger et al.

[11] Patent Number: 5,211,703

[45] Date of Patent: May 18, 1993

[54] STATIONARY BLADE DESIGN FOR L-OC ROW

[75] Inventors: Jurek Ferleger, Longwood; David H. Evans, Lake Mary, both of Fla.

[73] Assignee: Westinghouse Electric Corp., Pittsburgh, Pa.

[21] Appl. No.: 603,332

[22] Filed: Oct. 24, 1990

[51] Int. Cl.[5] ..... F01D 9/04

[52] U.S. Cl. ..... 415/181; 415/173.7; 416/223 A; 416/DIG. 5

[58] Field of Search ..... 415/108, 170.1, 173.6, 415/173.7, 181; 416/223 A, DIG. 5; 277/182-185, 197-199, 233, 234

[56] References Cited

U.S. PATENT DOCUMENTS

| | | | |
|---|---|---|---|
| 784,670 | 3/1905 | Fullagar | 415/173.7 |
| 2,640,679 | 6/1953 | Wheatley et al. | 415/173.7 |
| 2,934,259 | 4/1960 | Hausmann | 416/223 A |
| 3,475,108 | 10/1969 | Zickhur | 416/223 A |
| 4,626,174 | 12/1986 | Sato et al. | 416/223 A |
| 4,900,223 | 2/1990 | Groenendaal, Jr. | 415/190 |
| 4,900,230 | 2/1990 | Patel | 416/223 A |
| 4,915,581 | 4/1990 | Groenendaal, Jr. et al. | 415/108 |

*Primary Examiner*—Edward K. Look
*Assistant Examiner*—Christopher Verdier

[57] ABSTRACT

A stationary blade of a steam turbine having a rotor and an inner cylinder for mounting the stationary blade in a row with plural identical stationary blades, comprising an airfoil having a leading edge, a trailing edge, a pressure-side concave surface and suction-side convex surface extending between the leading and trailing edges. A stagger angle being defined by as an angle of a chord between the leading and trailing edges to a longitudinal axis of the rotor; an outer ring for connecting a proximal end of the airfoil to the inner cylinder; an inner ring connected to a distal end of the airfoil; and a seal assembly carried by the inner ring and sealingly engaging the rotor; wherein the stagger angle ranges from about 42° at the distal end of the airfoil to about 52° at the proximal end.

5 Claims, 7 Drawing Sheets

STATIONARY BLADE DESIGN FOR L-OC ROW

BACKGROUND OF THE INVENTION

1. Field of the Invention

The present invention relates generally to steam turbine blades and, more particularly, to a stationary blade having improved performance characteristics.

2. Description of the Related Art

Steam turbine rotor and stationary blades are arranged in a plurality of rows or stages. The rotor blades of a given row are identical to each other and mounted in a mounting groove provided in the turbine rotor. Stationary blades, on the other hand, are mounted on a cylinder which surrounds the rotor.

Turbine rotor blades typically share the same basic components. Each has a root receivable in the mounting groove of the rotor, a platform which overlies the outer surface of the rotor at the upper terminus of the root, and an airfoil which extends upwardly from the platform.

Stationary blades also have airfoils, except that the airfoils of the stationary blades extend downwardly towards the rotor. The airfoils include a leading edge, a trailing edge, a concave surface, and a convex surface. The airfoil shape common to a particular row of blades differs from the airfoil shape for every other row within a particular turbine. In general, no two turbines of different designs share airfoils of the same shape. The structural differences in airfoil shape result in significant variations in aerodynamic characteristics, stress patterns, operating temperature, and natural frequency of the blade. These variations, in turn, determine the operating life of the turbine blade within the boundary conditions (turbine inlet temperature, pressure ratio, and rotational speed), which are generally determined prior to airfoil shape development.

Development of a turbine for a new commercial power generation steam turbine may require several years to complete. When designing rotor blades for a new steam turbine, a profile developer is given a certain flow field with which to work. The flow field determines the inlet angles (for steam passing between adjacent blades of a row), gauging, and the force applied on each blade, among other things. "Gauging" is the ratio of throat to pitch; "throat" is the straight line distance between the trailing edge of one blade and the suction surface of an adjacent blade, and "pitch" is the distance in the tangential direction between the trailing edges of the adjacent blades.

These flow field parameters are dependent on a number of factors, including the length of the blades of a particular row. The length of the blades is established early in the design stages of the steam turbine and is essentially a function of the overall power output of the steam turbine and the power output for that particular stage.

Referring to FIG. 1, two adjacent blades of a row are illustrated in sectional views to demonstrate some of the features of a typical blade. The two blades are referred to by the numerals 10 and 12. The blades have convex, suction-side surfaces 14 and 16, concave pressure-side surfaces 18 and 20, leading edges 22 and 24, and trailing edges 26 and 28.

The throat is indicated in FIG. 1 by the letter "O", which is the shortest straight line distance between the trailing edge of blade 10 and the suction side surface of blade 12. The pitch is indicated by the letter "S", which represents the straight line distance between the trailing edges of &he two adjacent blades.

The width of the blade is indicated by the distance $W_m$, while the blade inlet flow angle is $\alpha 1$, and the outlet flow angle is $\alpha 2$.

"$\beta$" is the leading edge included flow angle, and the letter "s" refers to the stagger angle.

When working with the flow field of a particular turbine, it is important to consider the interaction of adjacent rows of blades. The preceding row affects the following row by potentially creating a mass flow rate near the base which cannot pass through the following row. Thus, it is important to design a blade with proper flow distribution up and down the blade length.

The pressure distribution along the concave and convex surfaces of the blade can result in secondary flow which results in blading inefficiency. These secondary flow losses result from differences in steam velocity between the suction and the pressure surfaces of the blades.

Regardless of the shape of the airfoil as dictated by the flow field parameters, the blade designer must also consider the cost of manufacturing the optimum blade shape. Flow field parameters may dictate a profile which cannot be produced economically, and inversely the optimum blade shape may otherwise be economically impractical. Thus, the optimum blade shape should also take into account manufacturability.

SUMMARY OF THE INVENTION

An object of the present invention is to provide an improved blade design with improved performance and manufacturability.

Another object of the present invention is to provide an improved blade design by controlling suction and pressure surface velocities to reduce secondary flow losses.

Another object of the present invention is to optimize steam velocity distribution along pressure and suction surfaces of the blade.

These and other objects of the invention are met by providing a stationary blade of a steam turbine having a rotor and an inner cylinder for mounting the stationary blade in a row with plural identical stationary blades, the blade including an airfoil having a leading edge, a trailing edge, a pressure-side concave surface and a suction-side convex surface extending between the leading edge and the trailing edge, a stagger angle being defined as an angle formed by a chord between the leading edge and the trailing edge and a longitudinal axis of the rotor, an outer ring for connecting a proximal end of the airfoil to the inner cylinder, an inner ring connected to a distal end of the airfoil, and a seal assembly carried by the inner ring and sealingly engaging the rotor, wherein the stagger angle range from about 42° at the distal end of the airfoil to about 52° at the proximal end. Preferably, the stagger angle is approximately coincident with a forging angle of the airfoil portion.

These and other features and advantages of the stationary blade of the present invention will become more apparent with reference to the following detailed description and drawings.

Figure 1:
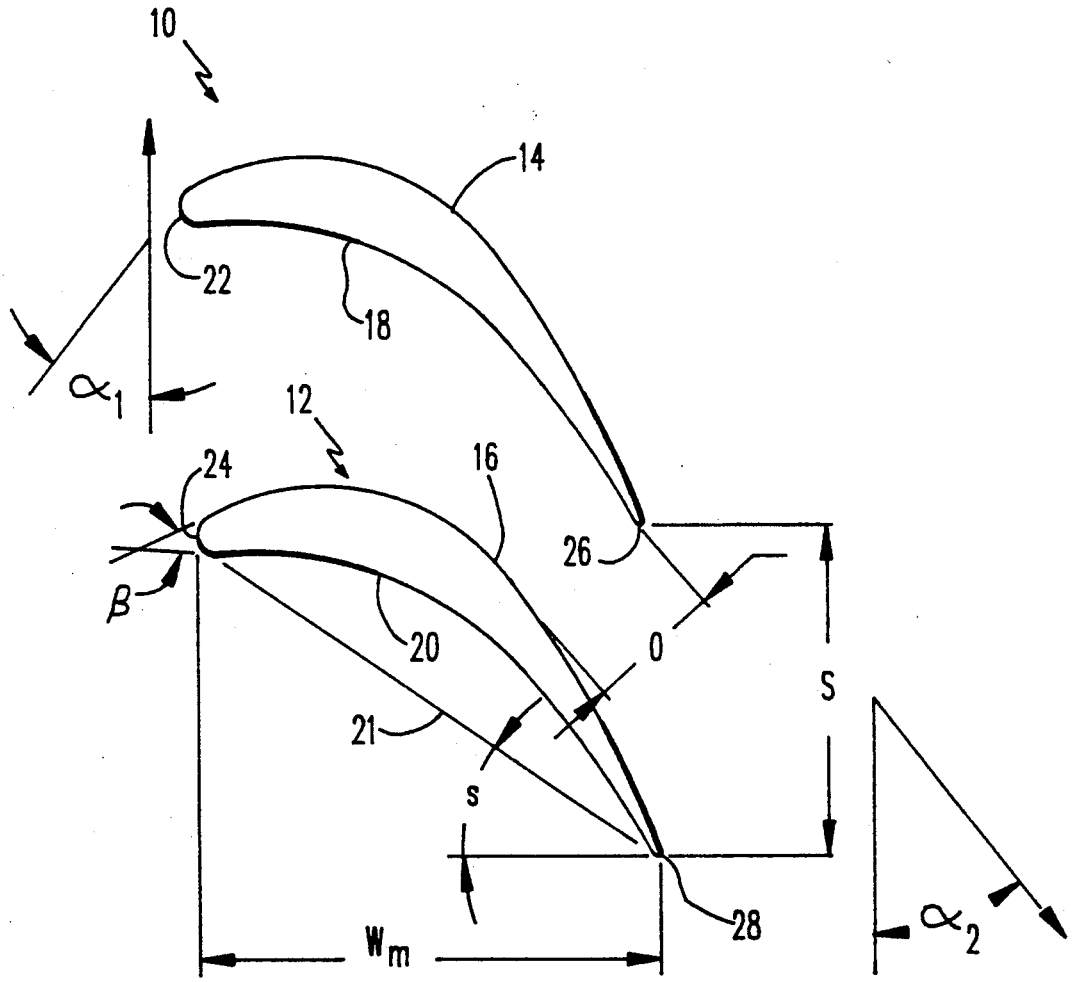
FIG. 1 PRIOR ART
FIG. 1 is a sectional view of two adjacent blades, illustrating typical blade features.

Similarly, the inner ring 44 is welded to the inner diameter end after separately forging the airfoil portion 40.

A seal assembly 46 is connected to the inner ring 44 and features two semi-annular retained plates 48 which carry a low diameter seal 50 which sealingly engages the rotor 32.

The inner ring 44 and seal assembly 46 have been constructed to tune the fundamental mode of the entire assembly between the multiples of turbine running speed, thus minimizing the risk of high cycle fatigue and failure. Specifically, the inner ring 44 has a reduced mass and, overall, the blade has an increased stiffness.

Figure 4:
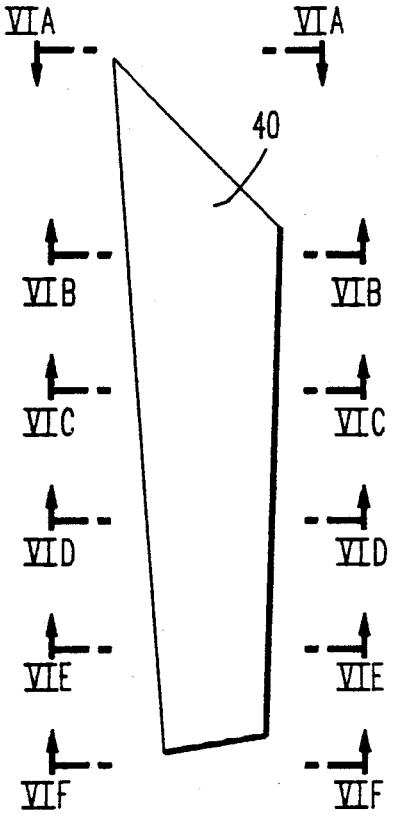
FIG. 4 is a side view of an airfoil portion of a turbine blade according to the present invention, as viewed from the convex side of the airfoll.
Figure 5:
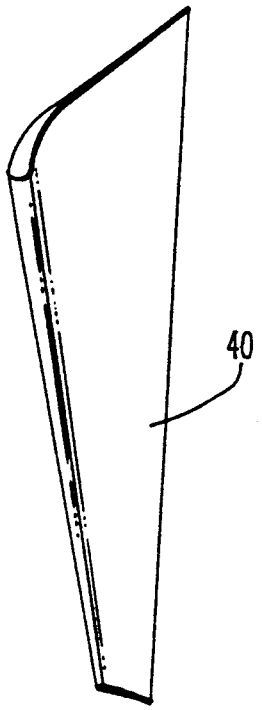
FIG. 5 is a side view of the airfoil portion of FIG. 4, as viewed from the direction of steam flow.
Figure 7:
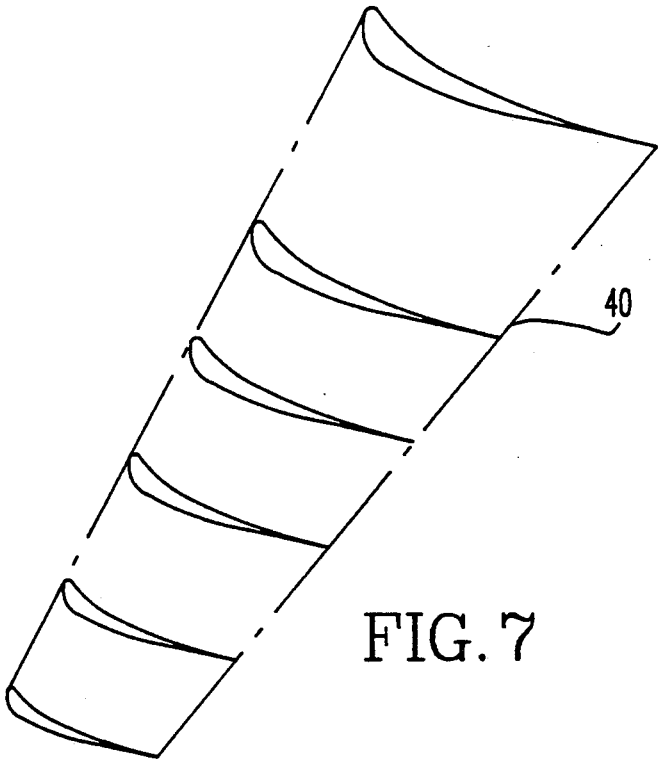
FIG. 7 is a perspective view of the airfoil portion of FIG. 4.
Figure 6A:
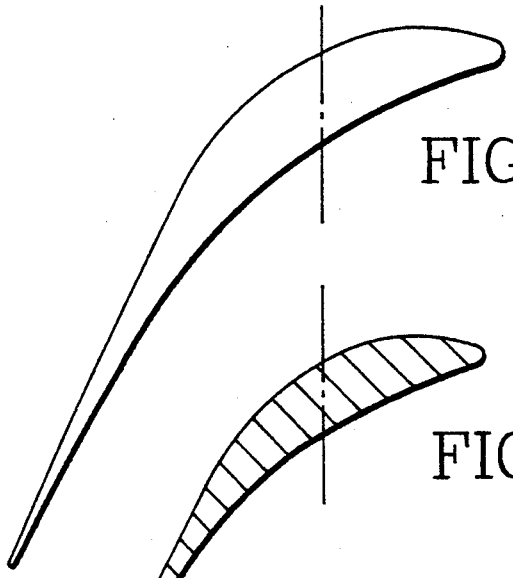
FIG. 6 is a stacked plot of airfoil sections A-A through F-F of FIG. 4.
Figure 6B:
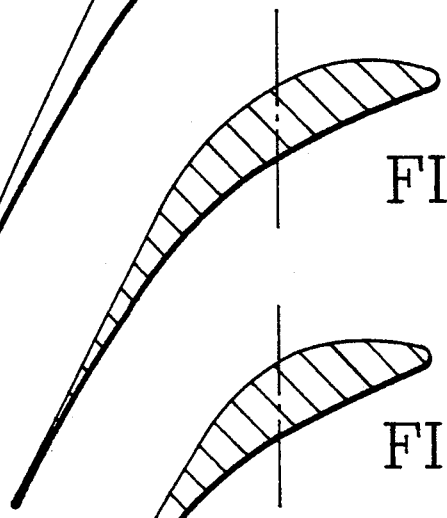
Figure 6C:
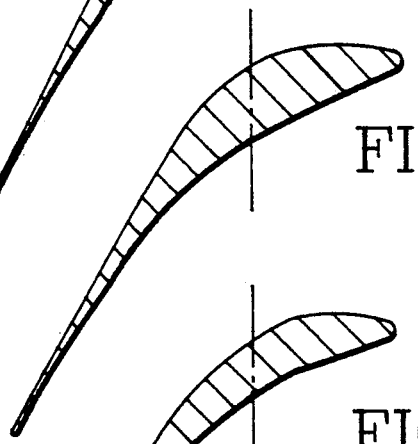
Figure 6D:
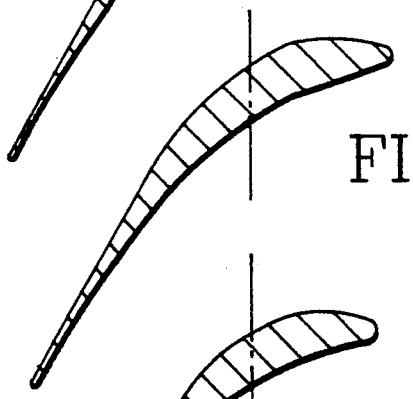
Figure 6E:
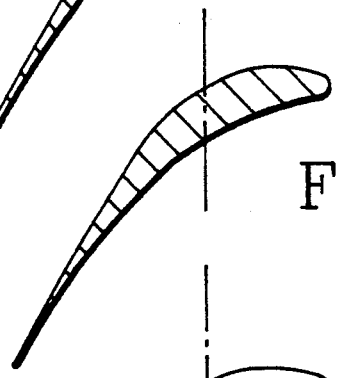
Figure 6F:
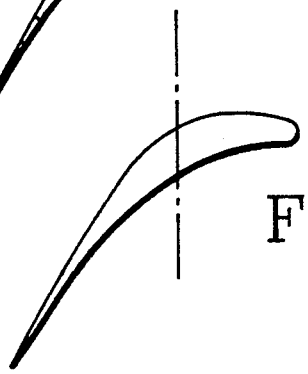

The airfoil 40 of the blade 38 is illustrated in FIG. 4, showing six basic sections A—A through F—F. As indicated in the drawing, the F—F section represents a point of diameter of the turbine of 57.83 inches (734.44 mm), or a radius of 28.915. Thus, the section F-F is 28.915 inches (734.44 mm) from the rotational axis of the rotor. Each successive section indicated in FIG. 4 is indicated to have a certain length from the tip, for example, the E-E section is 4.086 inches (103.78 mm) from the tip. The total length of the blade is inches, which corresponds to an outer diameter of 110.618 inches (2809.69 mm).

The following table summarizes the geometric and thermodynamic properties of the airfoil:

| SECTION | F-F | E-E | D-D | C-C | B-B | A-A |
|---|---|---|---|---|---|---|
| RADIUS (IN) | 28.9150 | 33.0000 | 38.0000 | 42.2500 | 47.1600 | 55.3090 |
| (mm) | 734.44 | 838.2 | 965.2 | 1073.15 | 1197.86 | 1404.84 |
| PITCH | 3.0280 | 3.4557 | 3.9793 | 4.4244 | 4.9386 | 5.7919 |
| WIDTH (IN) | 3.77080 | 4.14348 | 4.59836 | 4.98655 | 5.43415 | 6.17701 |
| (mm) | 95.778 | 105.27 | 116.79 | 126.65 | 138.02 | 156.89 |
| CHORD (IN) | 5.16956 | 5.91393 | 6.83293 | 7.62098 | 8.53437 | 10.05725 |
| (mm) | 131.30 | 150.21 | 173.55 | 193.57 | 216.77 | 255.45 |
| PITCH/WIDTH | .80300 | .83402 | .86538 | .88727 | .90880 | .93766 |
| PITCH/CHORD | .58573 | .58434 | .58238 | .58056 | .57867 | .57590 |
| STAGGER ANGLE (DEG) | 42.43684 | 44.95409 | 47.25245 | 48.77057 | 50.15513 | 51.88955 |
| MAXIMUM THICKNESS (IN) | .84959 | .88053 | .99624 | 1.11517 | 1.20043 | 1.50497 |
| (mm) | 21.579 | 22.365 | 25.304 | 28.325 | 30.490 | 38.226 |
| MAXIMUM THICKNESS/CHORD | .16435 | .14889 | .14580 | .14633 | .14066 | .14964 |
| EXIT OPENING (IN) | 1.05803 | 1.18237 | 1.32222 | 1.41012 | 1.42880 | 1.40640 |
| (mm) | 26.873 | 30.032 | 35.584 | 35.817 | 36.291 | 35.722 |
| EXIT OPENING ANGLE (DEG) | 21.65425 | 21.09941 | 20.37866 | 19.50799 | 17.66229 | 14.75031 |
| INLET ANGLE (DEG) | 68.5 | 70.01 | 83. | 89.37 | 81. | 77.99 |
| EXIT ANGLE (DEG) | 20.29 | 19.74 | 19.26 | 18.18 | 16.11 | 13.19 |
| INLET INCL. ANGLE (DEG) | 29.03433 | 33.96210 | 37.95736 | 43.26731 | 45.96139 | 49.84836 |
| EXIT INCL. ANGLE (DEG) | 1.36978 | 1.55336 | 1.41508 | 1.56480 | 1.47250 | 1.35697 |
| AREA (IN**2) | 2.41663 | 2.84713 | 3.59628 | 4.34487 | 5.268.15 | 7.82010 |
| ALPHA (DEG) | 42.54438 | 45.10505 | 47.33913 | 48.55989 | 49.90334 | 51.53337 |
| I MIN (IN**4) | .31592 | .40249 | .57550 | .83811 | 1.33679 | 2.97768 |
| I MAX (IN**4) | 3.10030 | 4.81590 | 7.91691 | 11.62644 | 17.67929 | 35.49366 |

DETAILED DESCRIPTION OF THE PREFERRED EMBODIMENTS

Figure 2:
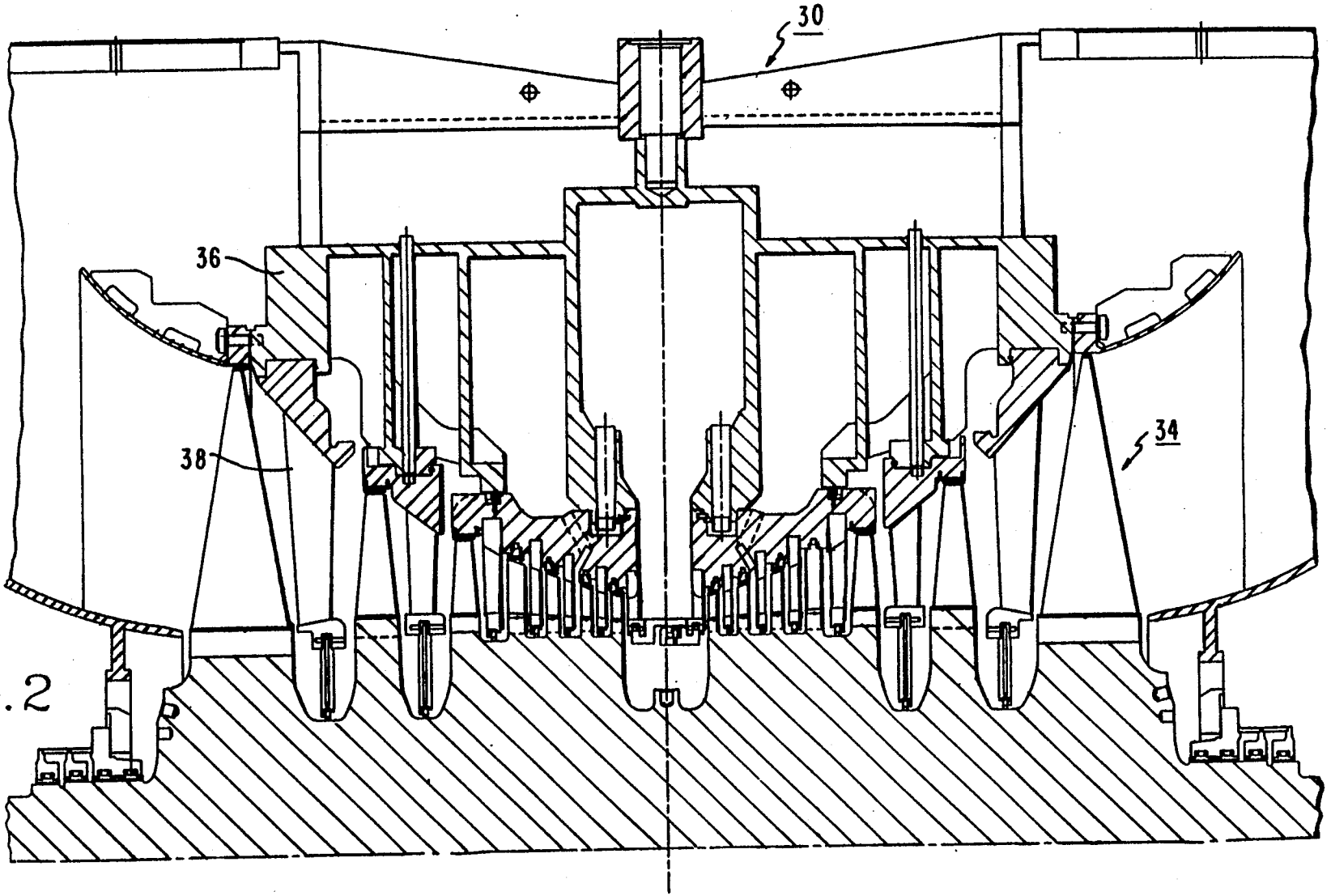
FIG. 2 is a vertical sectional view of a portion of a steam turbine incorporating a row of blades according to the present invention.
Figure 3:
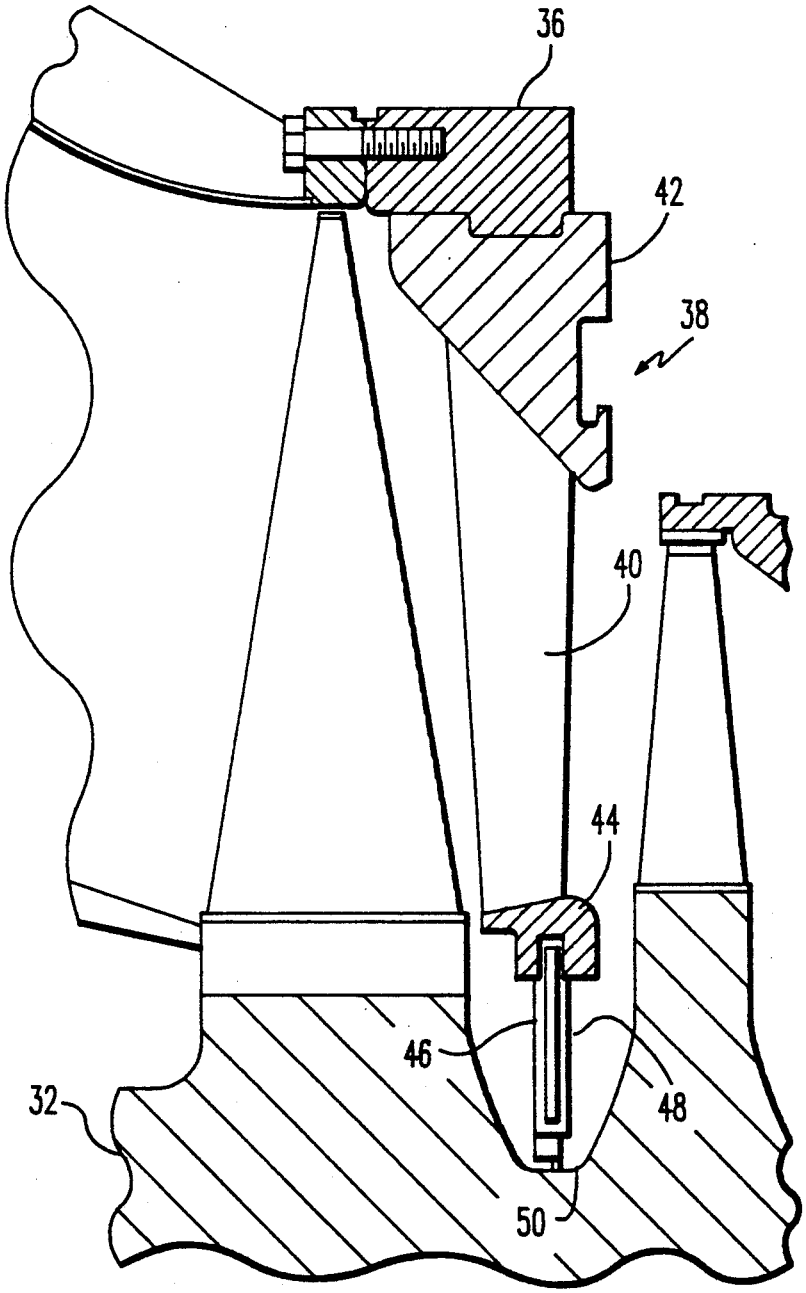
FIG. 3 is an enlarged view showing a portion of the steam turbine of FIG. 2 including the blade according to the present invention.

Referring to FIG. 2, a low pressure fossil fuel steam turbine 30 includes a rotor 32 carrying several rows or stages of rotary blades 34. An inner cylinder 36 carries plural rows of stationary blades, including the last row of stationary blades 38. Each row of blades has a row designation. As shown in FIG. 3, blade 38 is in row 7C, while the last row of rotary blades is designated 7R. The immediately upstream rotary blade row is referred to as 6R.

As shown in FIG. 3, the blade 38 includes an airfoil portion 40, an outer ring 42 for connecting the blade to the inner cylinder 36, and an inner ring 44 connected to an "inner diameter" distal end of the airfoil portion 40. The "outer diameter" end of the airfoil portion 40 is welded to the outer ring 42 in a segmental assembly fabrication process. The segmental assembly manufacturing process is helpful in saving manufacturing costs.

Figure 8:
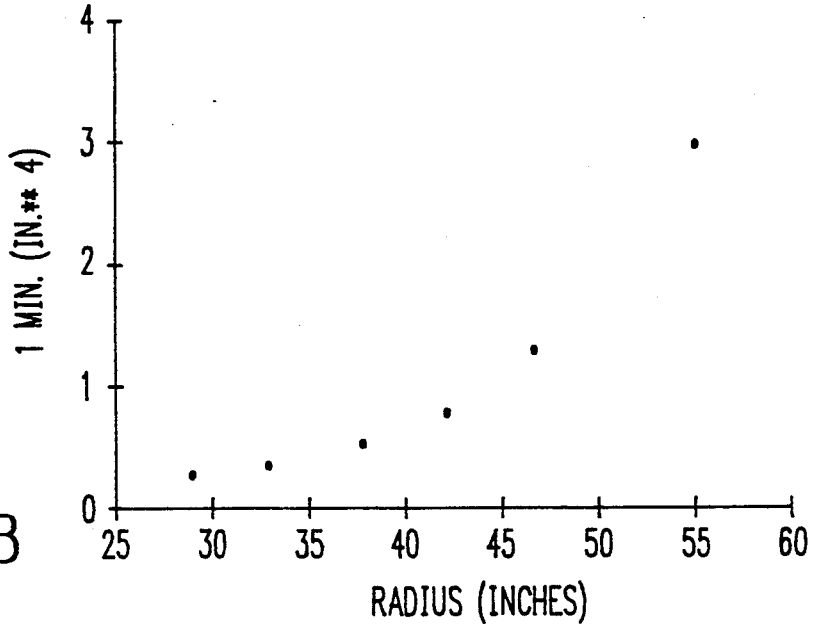
FIG. 8 is a graph showing I MIN versus radius of the airfoil portion of the blade according to FIG. 4.
Figure 9:
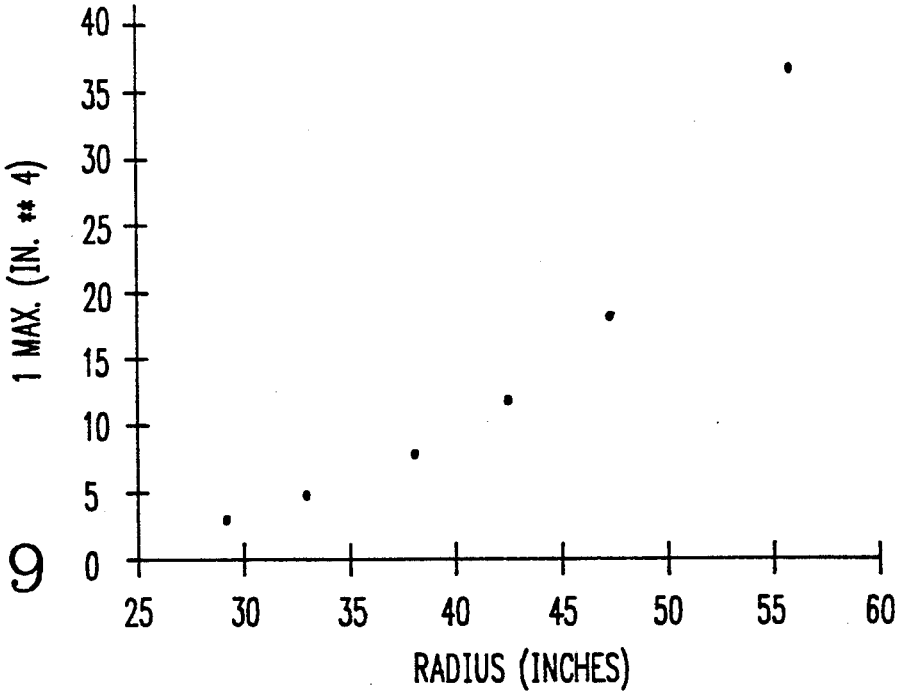
FIG. 9 is a graph showing I MAX versus radius for the airfoil portion of the blade according FIG. 4.

FIG. 8 shows the graph of I MIN versus radius, while FIG. 9 indicates I MAX versus radius. These two figures indicate an optimum radial distribution of stiffness to achieve an optimized stress distribution, as well as frequency control.

Figure 10:
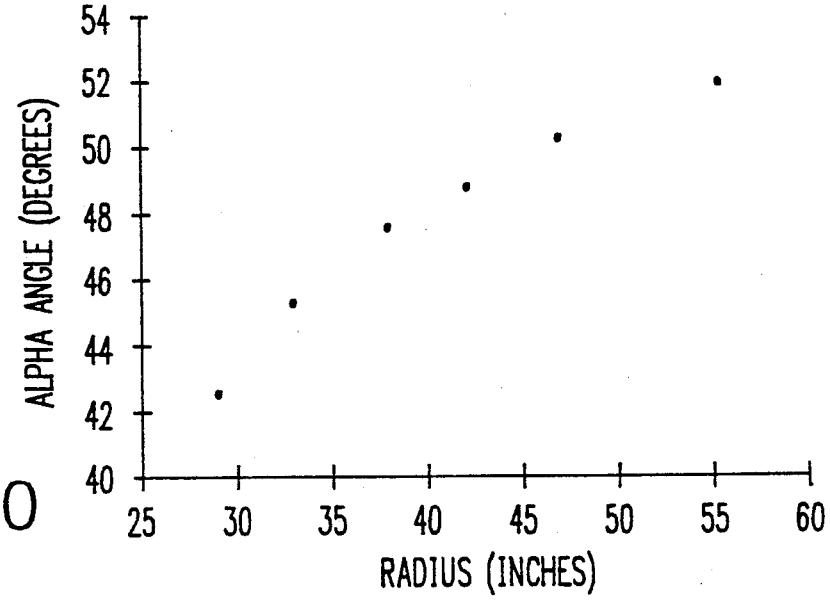
FIG. 10 is a graph showing alpha angle versus radius for the airfoil portion of the blade according to FIG. 4.
Figure 11:
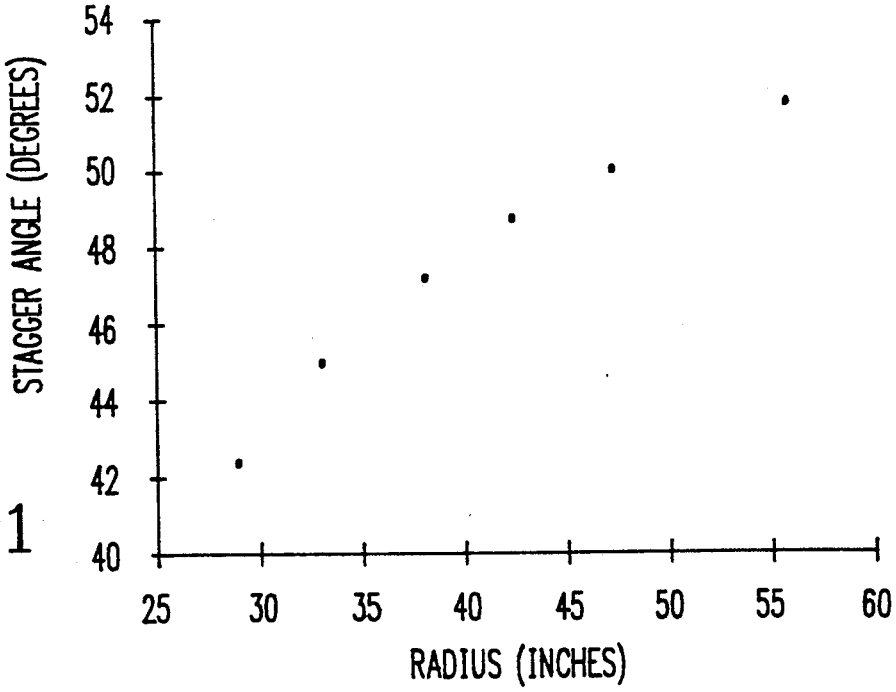
FIG. 11 is a graph showing stagger angle versus radius for the airfoil portion of the blade according to FIG. 4.

FIG. 10 is a graph of alpha angle versus radius, while FIG. 11 indicates stagger angle versus radius. The two curves are non-linear, smooth, and have similar values as a function of blade radius. The shape of the airfoil optimizes stress distribution, while taking into account manufacturability. Thus, in order to minimize forging energy, camber and stagger angle of the airfoil permit a forging angle of about 52°. Generally, it is preferable to keep the forging angle within plus or minus 5° of the average stagger. The shape of the airfoil is also effective in avoiding a negative draft angle, thus enhancing the manufacturability of the airfoil.

The overall stiffness and radial distribution of stiffness for the overall blade has been optimized to tune the lowest mode (the primary or fundamental mode) and has resulted in frequency of about 92.4 Hz, which is approximately midway between the harmonics of running speed for a turbine speed of 3600 rpm. This tuning is achieved by controlling the mass and stiffness of the blade. Also, the width of the blade is increased at the base to help achieve a greater overall stiffness.

Also, the shape described in the foregoing table allows pressure distribution across the section surfaces to be optimized so as to reduce secondary flow losses. This is achieved by optimizing the suction and pressure surfaces of the blade foil.

Numerous modifications and adaptations of the present invention will be apparent to those skilled in the art and thus, it is intended by the following claims to cover all such modifications and adaptations which fall within the true spirit and scope of the invention.

What is claimed is:

1. A stationary blade of a steam turbine having a rotor and an inner cylinder for mounting the stationary blade in a row with plural identical stationary blades, comprising:

an airfoil portion having a leading edge, a trailing edge, a pressure-side concave surface and suction-side convex surface extending between the leading and trailing edges, and having a stagger angle being defined as an angle of a chord between the leading and trailing edges to a longitudinal axis of the rotor;

an outer ring for connecting a proximal end of the airfoil portion to the inner cylinder;

an inner ring connected to a distal end of the airfoil portion; and a seal assembly carried by the inner ring and sealingly engaging the rotor;

wherein the stagger angle ranges from about 42° at the distal end of the airfoil to about 52° at the proximal end, wherein the airfoil portion is divided into six basic sections extending from an inner diameter end to an outer diameter end, wherein minimum moment of inertia and maximum moment of inertia values increase from the inner diameter section tot he outer diameter section, and wherein values of an inlet included angle at the six basic sections, proceeding from the inner diameter end to the outer diameter end, are as follows: 29.03°, 33.96°, 37.96°, 43.27°, 45.96°, 49.85°.

2. Blading for an L-OC row of a turbine in accordance with the following table:

| SECTION | F-F | E-E | D-D |
|---|---|---|---|
| RADIUS | | | |
| (IN) | 28.92 | 33.00 | 38.00 |
| (mm) | 734.44 | 838.2 | 965.2 |
| PITCH | 3.03 | 3.46 | 3.98 |
| WIDTH | | | |
| (IN) | 3.77 | 4.143 | 4.60 |
| (mm) | 95.78 | 105.27 | 116.79 |
| CHORD | | | |
| (IN) | 5.17 | 5.91 | 6.83 |
| (mm) | 131.30 | 150.21 | 173.55 |
| PITCH/WIDTH | .81 | .83 | .87 |
| PITCH/CHORD | .59 | .58 | .58 |
| STAGGER ANGLE (DEG) | 42.44 | 44.95 | 47.25 |
| MAXIMUM THICKNESS | | | |
| (IN) | .85 | .88 | 1.0 |
| (mm) | 21.58 | 22.37 | 25.30 |

-continued

| | | | |
|---|---|---|---|
| MAXIMUM THICKNESS/CHORD | .16 | .15 | .15 |
| EXIT OPENING | | | |
| (IN) | 1.06 | 1.18 | 1.32 |
| (mm) | 26.87 | 30.03 | 35.58 |
| EXIT OPENING ANGLE (DEG) | 21.65 | 21.10 | 20.38 |
| INLET ANGLE (DEG) | 68.5 | 70.01 | 83. |
| EXIT ANGLE (DEG) | 20.29 | 19.74 | 19.26 |
| INLET INCL. ANGLE (DEG) | 29.03 | 33.96 | 37.96 |
| EXIT INCL. ANGLE (DEG) | 1.37 | 1.55 | 1.42 |
| AREA (IN**2) | 2.42 | 2.85 | 3.60 |
| [ALPHA] FLOW ANGLE (DEG) | 42.54 | 45.11 | 47.34 |
| I MIN (IN**4) | .32 | .40 | .58 |
| I MAX (IN**4) | 3.10 | 4.82, | 7.92 |
| SECTION | C-C' | B-B | A-A |
| RADIUS | | | |
| (IN) | 42.25 | 47.16 | 55.31 |
| (mm) | 1073.15 | 1197.86 | 1404.84 |
| PITCH | 4.42 | 4.94 | 5.79 |
| WIDTH | | | |
| (IN) | 4.99 | 5.43 | 6.18 |
| (mm) | 126.65 | 138.02 | 156.89 |
| CHORD | | | |
| (IN) | 7.62 | 8.53 | 10.06 |
| (mm) | 193.57 | 216.77 | 255.45 |
| PITCH/WIDTH | .89 | .91 | .94 |
| PITCH/CHORD | .58 | .58 | .58 |
| STAGGER ANGLE (DEG) | 48.77 | 50.16 | 51.89 |
| MAXIMUM THICKNESS | | | |
| (IN) | 1.12 | 1.20 | 1.50 |
| (mm) | 28.33 | 30.49 | 38.23 |
| MAXIMUM THICKNESS/CHORD | 15 | .14 | .15 |
| EXIT OPENING | | | |
| (IN) | 1.41 | 1.43 | 1.41 |
| (mm) | 35.82 | 36.29 | 35.72 |
| EXIT OPENING ANGLE (DEG) | 19.51 | 17.66 | 14.75 |
| INLET ANGLE (DEG) | 89.37 | 81. | 77.99 |
| EXIT ANGLE (DEG) | 18.18 | 16.11 | 13.19 |
| INLET INCL. ANGLE (DEG) | 43.27 | 45.97 | 49.85 |
| EXIT INCL. ANGLE (DEG) | 1.56 | 1.47 | 1.36 |
| AREA (IN**2) | 4.34 | 5.27 | 7.82 |
| [ALPHA] FLOW ANGLE (D 48.56 | 49.90 | 51.53 | |
| I MIN (IN**4) | .84 | 1.34 | 2.98 |
| I MAX (IN**4) | 11.63 | 17.68 | 35.49 |

3. A stationary blade of a steam turbine having a rotor and an inner cylinder for mounting the stationary blade in a row with plural identical stationary blades, comprising:

an airfoil portion having a leading edge, a trailing edge, a pressure-side concave surface and suction-side convex surface extending between the leading and trailing edges, and having a stagger angle being defined as an angle of a chord between the leading and trailing edges to a longitudinal axis of the rotor;

an outer ring for connecting an outer end of the airfoil portion to the inner cylinder;

an inner ring connected to an inner end of the airfoil portion; and a seal assembly carried by the inner ring and sealingly engaging the rotor;

wherein the stagger angle ranges from about 42° at the inner end of the airfoil portion to about 52° at the outer end;

wherein the airfoil portion is divided into six basic sections extending from the inner end to the outer end;

wherein a value of minimum moment of inertia increases as follows: 0.32 inches at the inner end of the blade, 0.40 inch at 4.08 inches from the inner end, 0.58 inch at 9.08 inches from the inner end, 0.84 inch at 13.33 inches from the inner end, 1.34 inch at 18.24 inches from the inner end, and 2.98 inches at 26.39 inches from the inner end; and wherein values of an inlet included angle at the six basic sections, proceeding from the inner end to the outer end, are as follows: 29°, 33°, 37°, 43°, 45° and 49°.

4. A stationary blade as recited in claim 3, wherein a ratio of maximum thickness to chord for each section decreases from about 0.16 at the inner end section to about 0.15 at the outer end section; and wherein a chord of each section increases from about 5.17 inches (131.3 mm) at the inner end section to about 10 inches (255 mm) at the outer end section.

5. A stationary blade as recited in claim 3, wherein a ratio of pitch to chord decreases from about 0.59 at the inner end section to about 0.58 at the outer end section;

wherein a ratio of pitch to width increases from about 0.8 at the inner end section to about 0.94 at the outer end section;

wherein a ratio of maximum thickness to chord for each section decreases from about 0.16 at the inner end section to about 0.15 at the outer end section; and wherein a chord of each section increases from about 5.17 inches (131.3 mm) at the inner end section to about 10 inches (255 mm) at the outer end section.

* * * * *